US005228618A

United States Patent [19]

Afshar

[11] Patent Number: 5,228,618

[45] Date of Patent: Jul. 20, 1993

[54] THERMAL AND FLOW REGULATOR WITH INTEGRATED FLOW OPTIMIZER

[75] Inventor: Mohammad R. Afshar, Diamond Bar, Calif.

[73] Assignee: Hydrotech Chemical Corporation, City of Industry, Calif.

[21] Appl. No.: 798,165

[22] Filed: Nov. 26, 1991

[51] Int. Cl.[5] ..... G05D 23/12

[52] U.S. Cl. ..... 236/34.5; 236/92 C; 236/93 A

[58] Field of Search ..... 236/34.5, 92 C, 93 A, 236/92 R

[56] References Cited

U.S. PATENT DOCUMENTS

| | | | |
|---|---|---|---|
| 1,694,492 | 12/1928 | Tabler | 236/92 C |
| 1,972,170 | 9/1934 | Spencer | 236/92 C |
| 2,400,615 | 5/1946 | Warrock et al. | 236/34.5 |
| 2,400,911 | 5/1946 | Booth | 236/34.5 |
| 2,505,321 | 4/1950 | Brutocao et al. | 236/92 C X |
| 3,428,251 | 2/1969 | Gross et al. | 236/92 R |
| 3,554,440 | 1/1971 | Austin | 236/34.5 |
| 3,754,706 | 8/1973 | Tao | 236/92 R |
| 4,190,198 | 2/1980 | Casuga et al. | 236/34.5 |

*Primary Examiner*—William E. Tapolcai
*Attorney, Agent, or Firm*—Woodard, Emhardt, Naughton, Moriarty & McNett

[57] ABSTRACT

A valve assembly is disclosed which includes a first valve disc positionable against a valve seat in response to sensed temperature. The first valve disc includes a central aperture which is closeable by a second valve disc held in position by a compression spring. The second valve disc is displaced in response to liquid pressure. The valve assembly thereby provides for the independent control of flow through a passageway in response to temperature and/or pressure. The valve assembly has a particular application in conjunction with the control of bypass flow for a continuous flow liquid heater.

21 Claims, 3 Drawing Sheets

THERMAL AND FLOW REGULATOR WITH INTEGRATED FLOW OPTIMIZER

BACKGROUND OF THE INVENTION

1. Field of the Invention

The present invention relates to the field of fluid heaters, and especially to instantaneous heaters, and more particularly to a thermal and flow regulator for continuous flow liquid heaters.

2. Description of the Prior Art

Constant problems which have been associated with the operation of instantaneous fluid heaters are condensation and sedimentation. Units fired with gas fuel produce water vapor and carbon dioxide. When the flue products contact the heat exchanger, which has a temperature considerably below the dew point, condensation forms along the heat exchanger and moisture drops down on the burners and lining of the fire box, causing serious problems. Sedimentation within the piping is also affected by the liquid temperature, and can be very detrimental.

Liquid entering a heat exchanger has a relatively low inlet temperature. As it flows through the heat exchanger, the temperature of the liquid increases. However, this temperature level is still below the dew point of the flue products, therefore resulting in condensation of moisture on the outside of the exchanger. The temperature rise of the liquid to be heated depends on the flow rate through the heat exchanger tubes. A higher flow rate will result in a lower temperature rise and a lower rate will result in a higher temperature rise. Adjustment of the liquid flow rate can therefore be used to modify the liquid temperature, and consequently the amount of condensation which forms on the exterior of the exchanger.

The deposit of minerals in a liquid is also temperature related, accelerating as the liquid temperature increases. The forming of these mineral deposits will greatly reduce the heat transfer efficiency of the heat exchanger, since the deposits work as an insulator. Furthermore, within a relatively short period of time, the heat exchanger may become quite clogged, causing the entire system to fail.

Common practices to resolve the above-outlined problems are as follows. In one approach, the flow rate is regulated based on the pressure drop across the heat exchanger, using a plunger and spring assembly or constant orifices. In another approach, the flow rate is regulated with a temperature signal, but this has many limitations based on displacement of a sensor, etc.

The present invention reduces condensation and sedimentation substantially. The unique design features lead to the ability to regulate the liquid flow rate based on pressure drop and temperature across the heat exchanger with minimum restrictions.

SUMMARY OF THE INVENTION

Briefly describing one aspect of the present invention, there is provided a valve assembly for controlling the flow of a liquid, the assembly including a valve seat defining a first aperture, a first disc sized to be received upon the valve seat and having a closed position against the valve seat and an open position displaced therefrom, the first disc defining a second aperture, first control means responsive to changes in temperature for selectively positioning the first disc in the closed or open position, a second disc sized to be received against the first disc to close the second aperture, the second disc having a closed position against the first disc and an open position displaced therefrom, and second control means responsive to liquid pressure for selectively positioning the second disc in the closed or open position. In a particular embodiment, the first control means includes a power element which responds to changes in temperature, and a spring positioned in opposition thereto. Also in a preferred embodiment, the second control means includes a plunger which is spring biased into the closed position, but which opens in response to liquid pressure on the opposite side of the first disc.

It is an object of the present invention to provide an improved valve assembly for controlling the flow of liquid therethrough. Another object of the present invention is to provide a valve assembly which regulates liquid flow in response to temperature and/or liquid pressure.

It is a further object of the present invention to provide a thermal and flow regulator with an integrated flow optimizer.

Further objects and advantages of the present invention will be apparent from the description of the preferred embodiment which follows.

DESCRIPTION OF THE PREFERRED EMBODIMENT

For the purposes of promoting an understanding of the principles of the invention, reference will now be made to the preferred embodiment of the invention and specific language will be used to describe the same. It will nevertheless be understood that no limitation of the scope of the invention is thereby intended, such alterations, modifications and further applications of the principles of the invention being contemplated as would normally occur to one skilled in the art to which the invention relates.

The present invention provides a thermal and flow regulator with integrated flow optimizer, particularly one adapted for use with continuous flow liquid heaters. The design features of the invention provide the ability to regulate the liquid flow rate based on pressure drop and/or on temperature. Moreover, the design provides a minimum of flow restrictions, is readily constructed, and is highly reliable in use.

Referring in particular to the drawings, there is shown a valve assembly 10 constructed in accordance with the present invention. The valve assembly is generally cylindrical in nature, having a longitudinal axis 11. The valve assembly is generally cylindrical and symmetrical in form.

Figure 2:
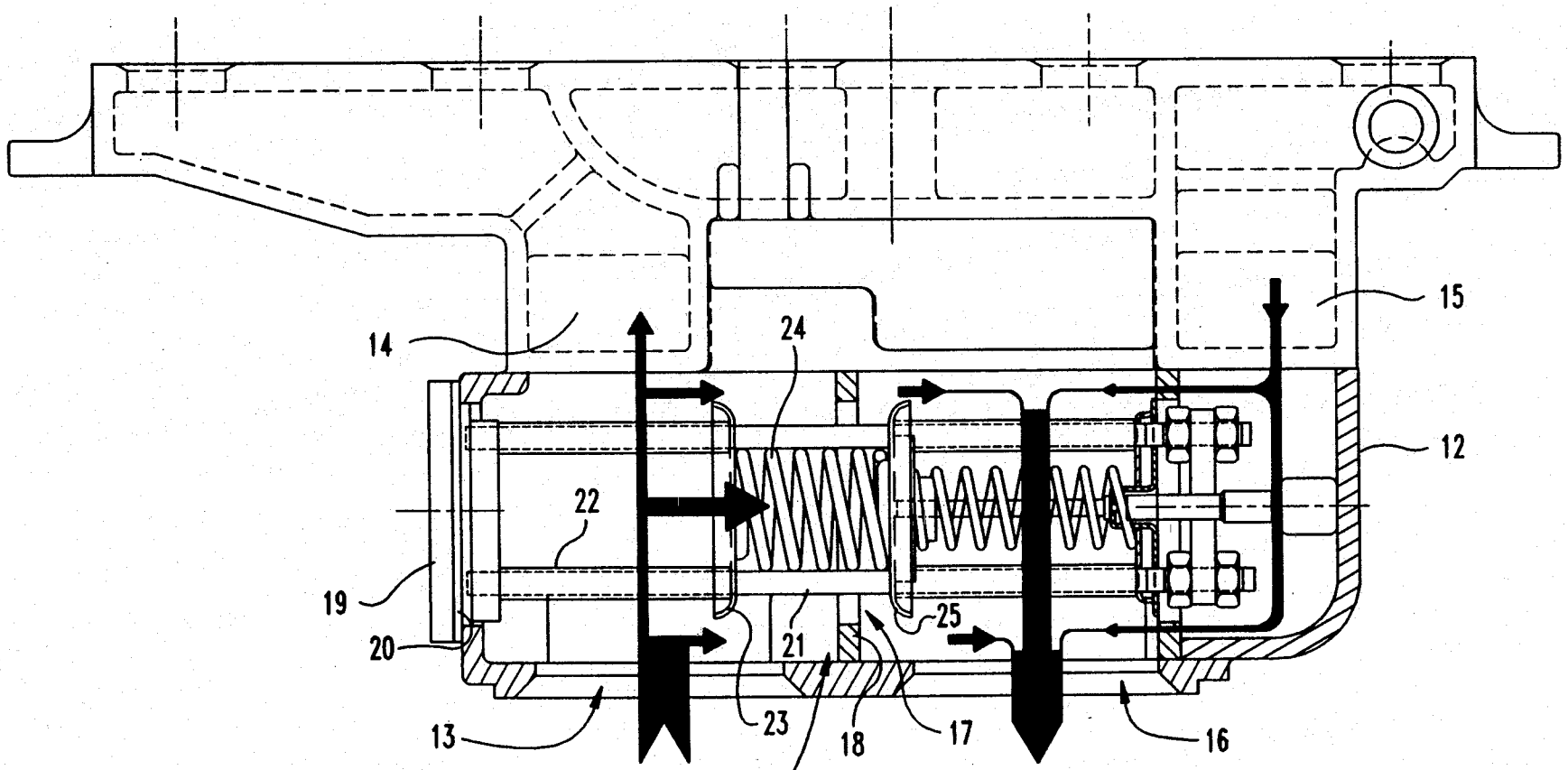
FIG. 2 is a partial, cross-sectional view showing the installation of the valve assembly of FIG. 1 in conjunction with a header for a heat exchanger.
Figure 4:
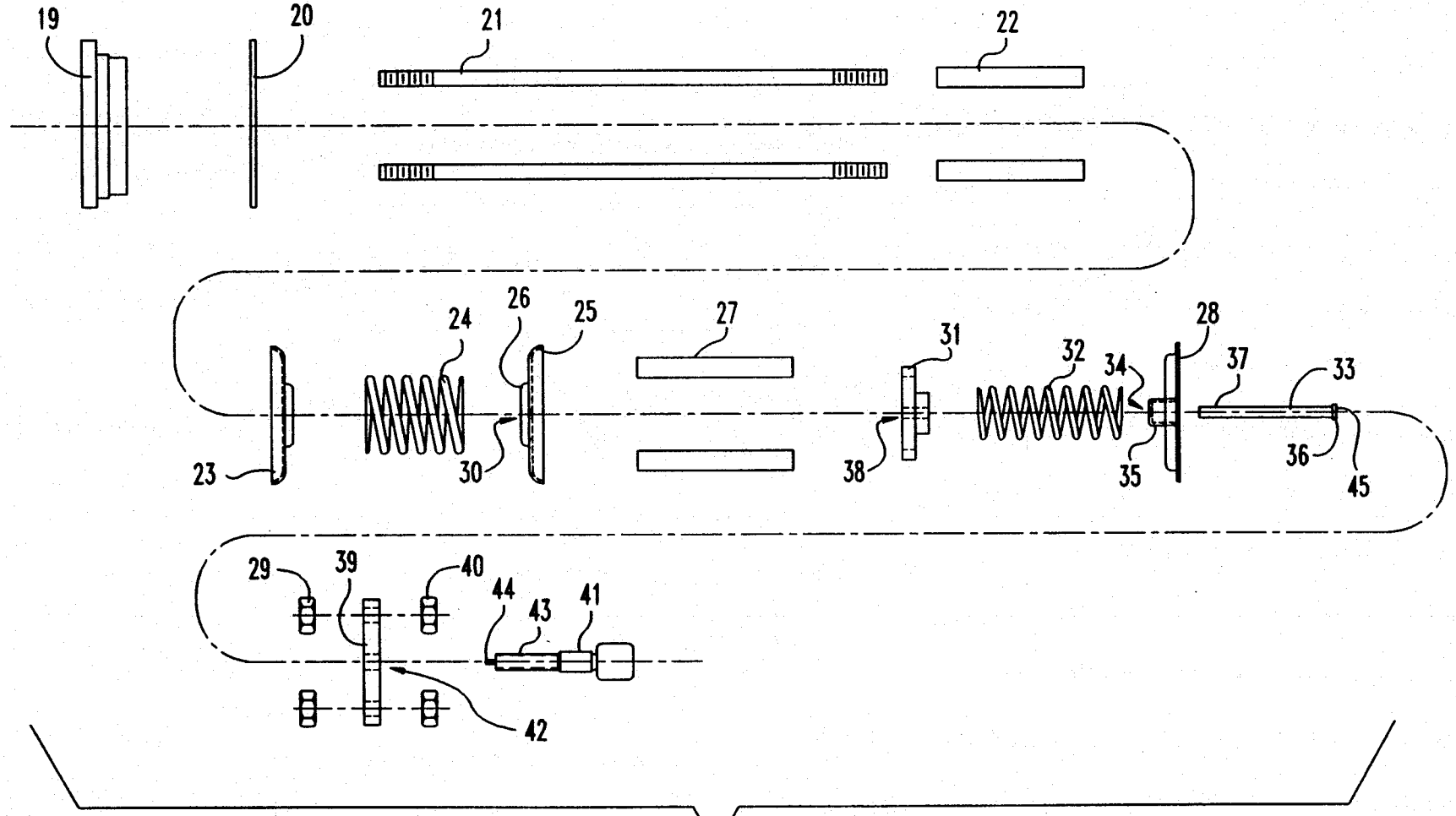
FIG. 4 is an exploded view showing the various components of the preferred valve assembly of the present invention.

Valve assembly 10 is received within a flow passageway and is useful for controlling the flow of liquid therethrough. As shown in FIG. 2, the valve assembly may be mounted, for example, within a header 12 to control bypass of liquid. Header 12 includes an inlet 13 and a passageway 14 which leads, for example, to heat exchanger elements (not shown). Primary flow of liquid enters through the inlet 13 and moves through passageway 14 to the heat exchanger. Liquid is returned from the heat exchanger through a return passageway 15 and passes out from the header through outlet 16. The header is also provided with a passageway 17 to permit bypass flow of liquid directly from the inlet 13 to the outlet 16. As shown in FIG. 2, a circular valve seat 18 is defined by the header, and defines the bypass passageway 17 closeable by the valve assembly of the present invention.

In the preferred embodiment shown in the drawings, the valve assembly 10 includes a cover 19 secured to the header 12 by suitable means, such as by bolts. A gasket 20 is provided to provide a fluid tight seal between the cover and the header. A pair of support rods 21 are secured at their first ends to the cover 19. Such securement preferably is achieved by providing the rods 21 with threaded first ends which are received within complementary threaded holes in the cover. First spacers 22 are received over the rods 21, and a spring holder 23 is received against the spacers. As shown in FIG. 2, bypass flow of liquid may occur, when permitted by the valve assembly, around the outside of spring holder 23. In addition, the spring holder includes a central aperture which permits the flow of liquid therethrough when open.

Figure 1:
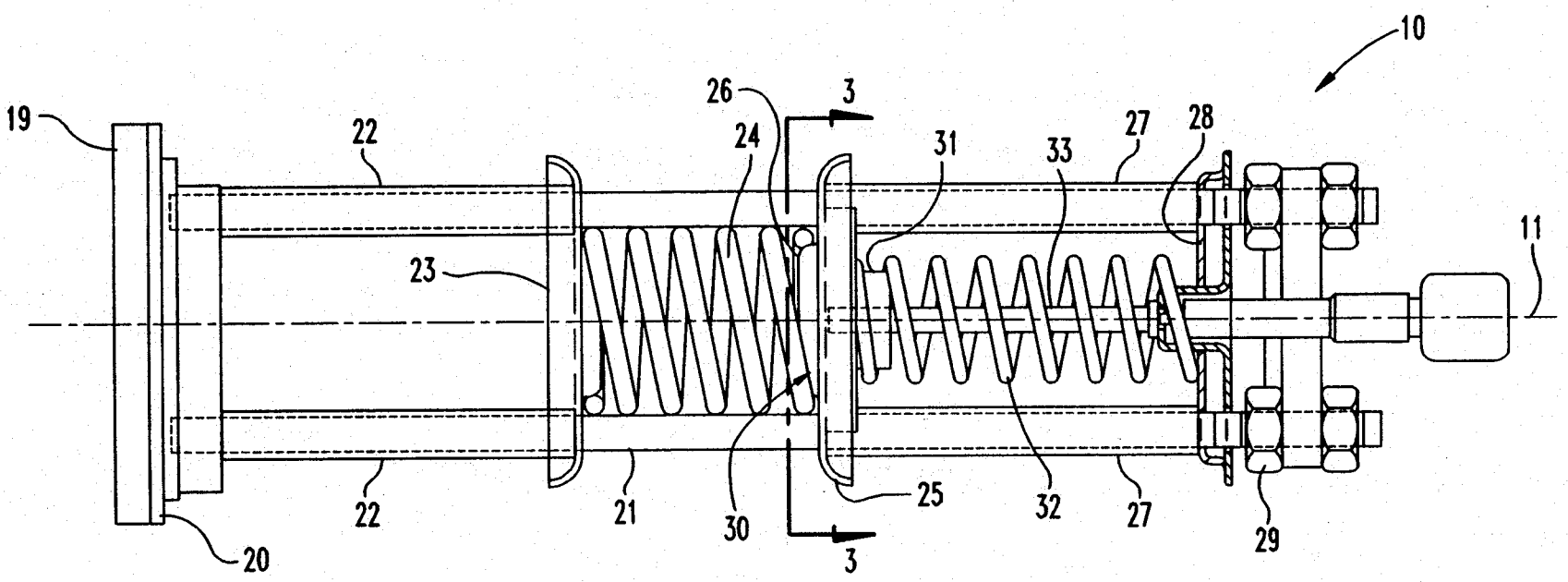
FIG. 1 is a side, elevational view showing a valve assembly constructed in accordance with the present invention.
Figure 3:
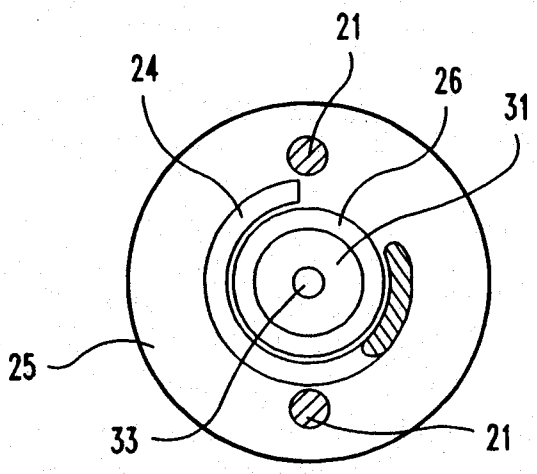
FIG. 3 is an end, plan view showing particular features of the valve components of the present invention.

A compression spring 24 is received against the spring holder 23, and a valve disc 25 is received against the other end of the spring. Both of the spring holder 23 and valve disc 25 include a pair of apertures adjacent their perimeters (FIG. 3) positioned to receive the rods 21 therein. In addition, both the spring holder and valve disc include raised, central portions 26 about which the cylindrical spring is received.

A second pair of spacers 27 are received over the rods 21 and abut against the valve disc 25. A second spring holder 28 includes a pair of apertures within which the rods 21 are received. Nuts 29 are received on threaded second ends of the rods 21 and provide an end stop for the second spring holder 28. Each of the valve disc 25, spacers 27 and spring holder 28 is slidingly received upon the rods 21. Spring 24 urges the valve disc 25, and therefore the spacers 27 and spring holder 28, away from the cover 19 and in the direction to the right in the drawings, ultimately against the nuts 29.

Valve disc 25 defines a central aperture 30. A second disc-shaped member 31 is sized to be received against the valve disc 25 to close the central aperture 30. A compression spring 32 is positioned between the disc member 31 and the second spring holder 28 to urge the disc member 31 against the valve disc 25, or in the direction to the left in the drawings. A spring rod 33 extends through an aperture 34 in the raised portion 35 of the second spring holder 28. The spring rod 33 includes an enlarged head 36 which is received against the spring holder 28 to retain the spring rod in position. The cylindrical body 37 of the spring rod 33 extends through the coil spring 32 and is slidingly received in a central aperture 38 of the disc member 31. Disc member 31 is also slidingly received by the spacers 22, and particularly includes a pair of opposed notches within which the spacers are received. The spring rod 33, spring 32 and disc member 31 thereby cooperate to provide closure of the central aperture 30 in the valve disc 25 by the pressure of spring 32, while permitting sliding displacement of the disc member 31 in opposition to the force of the spring 32.

A retainer 39 includes a pair of apertures within which the rods 21 are received. Nuts 40 are threadedly received upon the ends of the rods 21, and thereby fix the retainer 39 in position against the nuts 29. A power element 41 is secured to a central aperture 42 in retainer 39. Preferably, the power element 41 includes an externally threaded portion 43 which is threadedly received within the aperture 42. A movable control pin 44 extends outwardly of the power element 41, and is extendable along the central axis 11. This control pin 44, in the assembled valve system, abuts the face 45 of the spring rod 33. Since the spring rod in turn bears against the spring holder 28, any movement of the control pin to further extend outwardly of the power element will force the spring holder 28, spacers 27 and valve disc 25 in the direction against the opposing spring 24, i.e. to the left in the drawings.

It will be noted that the movement of the valve disc 25 in response to the power element 41 does not directly affect the spatial relationship between the disc member 31 and the valve disc 25. That is, disc member 31 is free to move relative the valve disc 25 independently of any movement of the valve disc 25 within the overall valve assembly.

Looking in particular to FIG. 2 and considering the foregoing description, it will be apparent that the valve assembly of the present invention permits the control of liquid flow in response to two separate parameters. The valve disc 25 is free to move back and forth within the assembly, being urged in one direction by the spring 24, and in the other direction by the power element 41. The power element 41 could be provided for a response to a variety of parameters. In the preferred embodiment, the power element is responsive to changes in temperature, particularly the temperature of the liquid passing to the outlet 16. As the temperature rises, the control pin 44 extends further from the power element, thereby moving the valve disc 25 against the spring 24 and toward a closed position received against the valve seat 18. For reduced temperatures, the control pin does not extend as far from the power element, and the spring 24 urges the valve disc 25 away from the valve seat to increase liquid flow through the bypass passageway 17.

Independently of the foregoing temperature-responsive valve function, the disc member 31 provides valving in response to liquid pressure. The disc member 31 is held against the valve disc 25 by the pressure of the compression spring 32. A relative force against the disc 31 through the central aperture 30 of the valve disc 25 which sufficiently exceeds the spring force will move the disc member away from the valve disc 25, thereby opening the central aperture 30 to permit liquid flow therethrough.

It will therefore be appreciated that this dual purpose valve permits substantially independent control of liquid flow in response to temperature and/or pressure. For example, at sufficiently high temperatures, the power element through control pin 44 will move the valve disc 25 to a fully closed position, thereby maximizing flow of liquid through the heat exchanger, and consequently reducing the temperature of the exiting liquid. At the same time, the presence of a sufficiently high pressure of the liquid at the inlet 13 will overcome the force of spring 32 and move the disc member 31 away from the valve disc 25, thus permitting bypass flow through aperture 30 in response to this relatively high pressure. Conversely, the valve assembly could have a condition in which the valve disc 25 is displaced from the valve seat because of low temperature for the liquid exiting through the return passageway 15, while at the same time the liquid pressure would be below that required to displace the disc member 31 from the valve disc 25. Of course, other conditions could result in both valving discs 25 and 31 being in the relatively closed (high temperature, low pressure) or open (low temperature, high pressure), as well as various intermediate positions.

The present invention has been described in a preferred embodiment for use with a continuous flow liquid heater. It has been found that in this application the valve assembly is particularly desirable to dictate bypass flow in response to liquid pressure and/or temperature. For example, one advantage is that the outlet temperature for the liquid can be maintained below a critical sedimentation point by regulating flow through the heat exchanger. Similarly, monitoring of the temperature can be used to avoid approaching the potential condensation point for the system.

While the invention has been described in the foregoing description, the same is to be considered as illustrative and not restrictive in character, it being understood that only the preferred embodiments have been described and that all changes and modifications that come within the spirit of the invention are desired to be protected.

What is claimed is:

1. A valve assembly for reception within a flow passageway for controlling the flow of liquid therethrough which comprises:

a valve seat member defining a first aperture for the flow of liquid therethrough;

a first disc sized to be received upon the valve seat, said first disc having a closed position received against said valve seat and an open position displaced in a first direction from said valve seat, said first disc defining a second aperture;

first control means responsive to changes in one of temperature or pressure for selectively moving said first disc toward one of the closed and open positions;

a second disc sized to be received against said first disc closing the second aperture, said second disc having a closed position received against said first disc and an open position displaced in the first direction from said first disc; and second control means responsive to the one of pressure or temperature different than for said first control means for selectively moving said second disc toward one of the closed and open positions.

2. The valve assembly of claim 1 in which said first control means is for urging said first disc toward the closed position at temperatures above a predetermined temperature, and for urging said first disc toward the open position at temperatures below the predetermined temperature.

3. The valve assembly of claim 2 in which said first control means includes first biasing means for urging said first disc to the closed position at temperatures above a predetermined temperature, and second biasing means for urging said first disc to the open position at temperatures below the predetermined temperature.

4. The valve assembly of claim 1 in which said second control means is for moving said second disc toward the closed position at liquid pressures below a predetermined pressure, and for moving said second disc toward the open position at liquid pressures above the predetermined pressure.

5. The valve assembly of claim 4 in which said first control means is for urging said first disc toward the closed position at temperatures above a predetermined temperature, and for urging said first disc toward the open position at temperatures below the predetermined temperature.

6. The valve assembly of claim 4 in which said second control means includes first positioning means for positioning said second disc in the closed position at liquid pressures below a predetermined pressure, and second positioning means for positioning said second disc in the open position at liquid pressures above the predetermined pressure.

7. The valve assembly of claim 6 in which said first control means includes first biasing means for urging said first disc toward the closed position at temperatures above a predetermined temperature, and second biasing means for urging said first disc toward the open position at temperatures below the predetermined temperature.

8. The valve assembly of claim 7 in which said first biasing means comprises a temperature-expansive member.

9. The valve assembly of claim 7 in which said second biasing means comprises a spring.

10. The valve assembly of claim 9 in which said first biasing means comprises a temperature-expansive member.

11. The valve assembly of claim 7 in which said first positioning means comprises a spring.

12. The valve assembly of claim 11 in which said first biasing means comprises a temperature-expansive member.

13. The valve assembly of claim 11 in which said second biasing means comprises a spring.

14. The valve assembly of claim 13 in which said first biasing means comprises a temperature-expansive member.

15. A flow regulator for controlling the flow of liquid therethrough which comprises:

a chamber including a flow passageway and a second passageway, the flow passageway defining a valve seat within the flow passageway, the valve seat including a first aperture for the flow of liquid therethrough;

a first disc sized receivable upon the valve seat, said first disc having a closed position received against said valve seat and an open position displaced from said valve seat, said first disc defining a second aperture;

first control means responsive to changes in one of temperature or pressure for selectively moving said first disc in directions toward one of the closed and open positions;

a second disc sized receivable against said first disc closing the second aperture, said second disc having a closed position received against said first disc and an open position displaced from said first disc; and second control means responsive to the one of pressure or temperature other than the one for said first control means for selectively moving said second disc in directions toward one of the closed and open positions, flow occurring through the flow passageway when either of said first disc or said second disc are in the open position and through the second passageway when both said first disc and said second disc are in the closed positions.

16. The flow regulator of claim 15 in which said first control means includes first biasing means for urging said first disc to the closed position at temperatures above a predetermined temperature, and second biasing means for urging said first disc to the open position at temperatures below the predetermined temperature.

17. The flow regulator of claim 15 in which said second control means includes first positioning means for moving said second disc toward the closed position at liquid pressures below a predetermined pressure, and second positioning means for moving said second disc toward the open position at liquid pressures above the predetermined pressure.

18. The flow regulator of claim 17 in which said first control means includes first biasing means for urging said first disc to the closed position at temperatures above a predetermined temperature, and second biasing means for urging said first disc to the open position at temperatures below the predetermined temperature.

19. The flow regulator of claim 18 in which said first biasing means comprises a temperature-expansive member coupled with said chamber and means connecting the member with said first disc to move said disc toward the closed position upon expansion of the member.

20. The flow regulator of claim 18 in which said second biasing means comprises a spring coupled with said chamber and bearing against said first disc.

21. The flow regulator of claim 18 in which said first positioning means comprises a spring coupled with said chamber and bearing against said second disc.

* * * * *